United States Patent [19]

Garay

[11] Patent Number: 4,992,799

[45] Date of Patent: Feb. 12, 1991

[54] ADAPTABLE ANTENNA

[75] Inventor: Oscar M. Garay, Coral Springs, Fla.

[73] Assignee: Motorola, Inc., Schaumburg, Ill.

[21] Appl. No.: 414,168

[22] Filed: Sep. 28, 1989

[51] Int. Cl.[5] ..... H01Q 1/24

[52] U.S. Cl. ..... 343/702; 343/724; 343/700 MS; 343/866

[58] Field of Search ..... 343/702, 853, 866, 869, 343/871, 700 MS, 724

[56] References Cited

U.S. PATENT DOCUMENTS

| | | | |
|---|---|---|---|
| 2,292,163 | 8/1942 | Shea | 343/702 |
| 4,123,756 | 10/1978 | Nagata et al. | 343/702 |
| 4,313,119 | 1/1982 | Garay et al. | 343/702 |
| 4,342,999 | 8/1982 | Woodward et al. | 343/702 |
| 4,701,763 | 10/1987 | Yamamoto et al. | 343/702 |
| 4,847,625 | 7/1989 | Dietrich et al. | 343/700 MS |

*Primary Examiner*—Rolf Hille
*Assistant Examiner*—Hoanganh Le
*Attorney, Agent, or Firm*—Michael J. Buchenhorner

[57] ABSTRACT

An antenna with a first and second portions (16 and 18) that are rotatably movable with respect to each other. The antenna may be rotated from a first position to a second position and from the second position to the first position so that it operates as two antennas while in the first position and as a loop antenna while in the second position.

6 Claims, 2 Drawing Sheets

FIG. 3
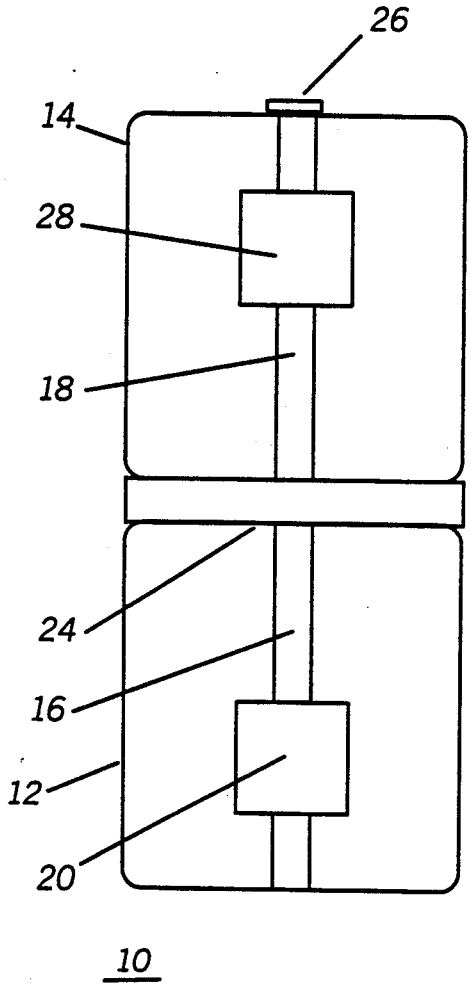
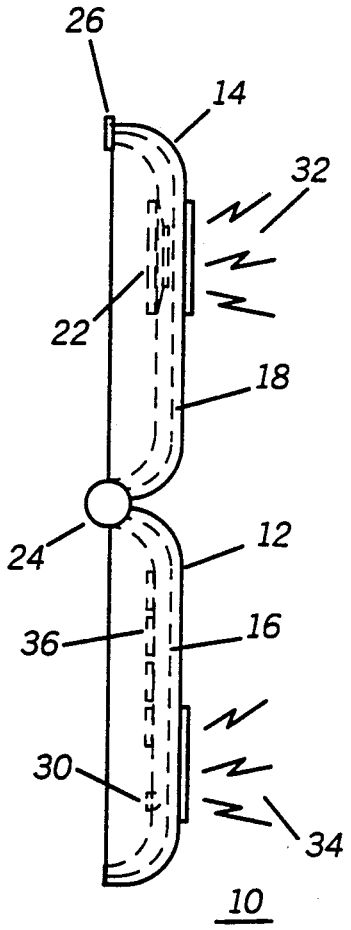
FIG. 4

ADAPTABLE ANTENNA

TECHNICAL FIELD

This invention relates generally to antennas and more specifically, to antennas for use in portable radios.

BACKGROUND

Antennas used in portable radio applications typically have problems with sensitivity when worn on or used near the human body because of the attenuation effects associated therewith. Moreover, in the transmission mode it is undesirable to use omnidirectional antennas because the human body attenuates the radiation transmitted in its direction. Additional problems associated with antennas used in portable radio applications are the limitation on the size of the antenna and the undesirability of antennas protruding from the radio.

SUMMARY OF THE INVENTION

Accordingly, it is an object of the present invention to provide an antenna that may be used in portable radios that avoids the detriments of prior antennas used for the same or similar applications.

Briefly, according to the invention, an antenna comprises a first portion and a second portion that is rotatably movable with respect to the first portion. The second portion of the antenna may be rotated from a first position to a second position so that the antenna operates as two antennas while in the first position and as a loop antenna while in the second position.

BRIEF DESCRIPTION OF THE DRAWINGS

FIG. 3 is a buttom view of the communication device shown in FIG. 1, in an open position.

FIG. 4 is a cross view of the communication device shown in FIG. 1, in the open position.

DETAILED DESCRIPTION OF THE PREFERRED EMBODIMENT

Figure 1:
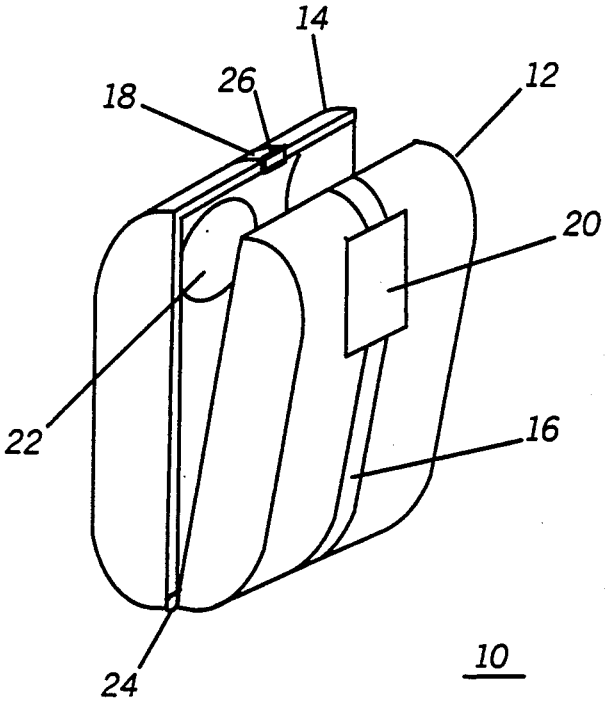
FIG. 1 is an oblique view of a portable communication device with an antenna in accordance with the present invention.

Referring to FIG. 1, a portable communication device 10 in accordance with the present invention is shown. The communication device 10 includes a first member 12 and a second member 14. The second member 14 is rotatably attached to the first member by means of a hinge 24 (or any other hinge means). The communication device 10 is shown in a partially open position, in which it may not be operative, for illustration purposes only. In this position the interior of the communication device 10 is partially visible, revealing a portion of a speaker 22 contained in the second member 14.

A first antenna portion 16 is attached to the first member 12. A second antenna portion 18 is attached to the second member 14 and is coupled to the first antenna portion 16 through the hinge 24. A clasp 26 is connected to the second antenna portion 18 and is rigidly attached to the second member 14. The first antenna portion 16 is also electromagnetically coupled to a first patch antenna portion 20.

Figure 2:
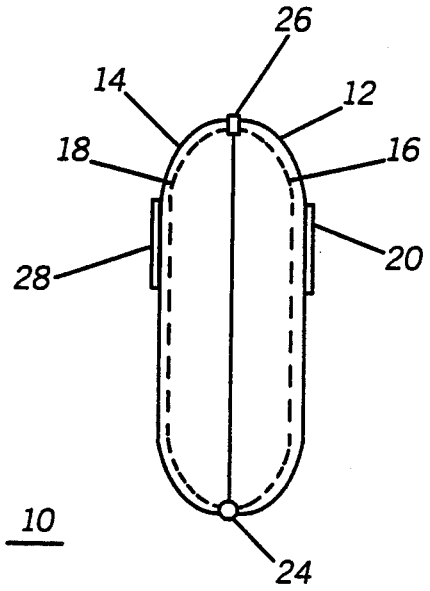
FIG. 2 is a side view of the communication device shown in FIG. 1, in a closed position.

Referring to FIG. 2, there is shown a side view of the communication device 10 in a closed position. In this position, the first member 12 and the second member 14 are joined by the clasp 26 and the first antenna portion 16 (shown by a broken line) is coupled to the second antenna portion 18 (also shown by a broken line), thus forming a loop antenna that operates in a magnetic-field mode (i.e., it receives and transmits H field waves). The first patch antenna portion 20 and a second patch antenna portion 28 are electromagnetically coupled to the first and second antenna portions, 16 and 18, respectively. The first and second patch antenna portions 28 and 20 are not active while the communication device 10 is in the closed position.

The communication device 10 is preferably used in a receiving, or standby, mode while in the closed position. Thus, the communication device 10 may be worn on the body of a person using it. Use of the communication device 10 on or near the human body, while the communication device 10 is in the closed position, is advantageous because the human body enhances the performance of the communication device 10 by providing a good ground plane for the loop antenna. In addition, the loop, formed by the first and second antenna portions, 16 and 18, avoids undesirable protrusions from the communication device 10.

Referring to FIG. 3, there is shown a bottom view of the communication device 10, in an open position. In this position the first and second antenna portions 16 and 18 do not form a loop antenna and, the first antenna portion 16 and the second antenna portion 18 act as transmission lines for applying signals to and receiving signals from the first and second patch antenna portions 20 and 28, respectively. Thus, the first and second patch antenna portions 20 and 28 become dominant. The first and second patch antenna portions, 20 and 28, each operate in an electric/field mode (i.e., they transmit and receive E field waves). It is advantageous to have two patch antennas while the communication device 10 is in use because the first patch antenna portion 20 may be used to transmit and the second patch antenna element 28 may be used to receive. Moveover, if the patch antennas are used as one antenna, and each patch antenna resonates at a different frequency, the effective bandwidth of the communication device 10 is increased.

Referring to FIG. 4, there is shown a cross view of the communication device 10, in the open position. The speaker 22 is mounted within the second member 14 and a microphone 30 is mounted within the first member 12 so that persons using the communication device 10 may hold to their faces the side containing the exterior portions of the speaker 22 and of the microphone 30. A keybroad 36 may be located on the same side of the communication device 10.

The signals to be transmitted may applied to the first patch antenna portion 20 or the second patch antenna portion 28 through the first antenna portion 16 or the second antenna portion 18, respectively. The first patch antenna portion 20 (or the second patch antenna portion 28) then transmits the signal 32 (or 34), only in the dirction shown in FIG. 4 (i.e., they are undirectional), thus avoiding the attenuation resulting from transmission in the direction of the user.

Therefore, the comnmunication device 10 has the advantage over other communication devices that it operates as a loop antenna when it is in a closed position and it may either operate as two patch antennas or as a single patch antenna with two different frequencies, when it is in the open position.

What is claimed is:

1. An antenna system comprising:

a first antenna portion;

a second antenna portion rotatably coupled to the first antenna portion, the antenna system being movable from an open position to a closed position, in which the first antenna portion is coupled to the second antenna portion to operate as a loop antenna, and movable from the closed position to the open position;

a first patch antenna element coupled to the first antenna portion; and a second patch antenna element coupled to the second antenna portion, so that the antenna system is coupled to operate as two patch antennas when the antenna system is in the open position.

2. The antenna of claim 1, wherein the first patch antenna element and the second patch antenna element have different resonant frequencies.

3. The antenna of claim 2, wherein the first patch antenna portion operates in a transmission mode and the second patch antenna portion operates in a reception mode.

4. The antenna of claim 1, wherein the antenna system operates as two unidirectional patch antennas when the antenna system is in the open position.

5. An antenna system comprising:

a first antenna portion;

a second antenna portion rotatably coupled to the first antenna portion so that the second antenna portion may be moved from an open position to a second closed position and from the closed position to the open position;

a patch antenna element coupled to the first antenna portion, so that the antenna system operates as a patch antenna when the antenna system is in the open position, and as a loop antenna when the antenna system is in the closed position.

6. The antenna system of claim 5, wherein the antenna system operates as a unidirectional patch antenna when it is in the open position.

* * * * *